United States Patent [19]

Totty et al.

[11] 4,336,747

[45] Jun. 29, 1982

[54] PRODUCT AND METHOD OF MAKING BELLOWS

[75] Inventors: Ray S. Totty; Gary N. Love; Jeffrey L. Zolot, all of Columbia, Tenn.

[73] Assignee: Packaging Associates, Inc., Columbia, Tenn.

[21] Appl. No.: 144,290

[22] Filed: Apr. 28, 1980

[51] Int. Cl.[3] ..... F01B 19/00

[52] U.S. Cl. ..... 92/43; 92/46; 92/47; 92/92

[58] Field of Search ..... 92/34, 45, 46, 47, 92, 92/42, 43

[56] References Cited

U.S. PATENT DOCUMENTS

| | | | |
|---|---|---|---|
| 3,090,403 | 5/1963 | Kroekel | 92/45 |
| 3,224,344 | 12/1965 | Baumann | 92/45 |
| 3,482,302 | 12/1969 | Williams | 92/45 |
| 3,495,502 | 2/1970 | Bousso | 92/34 |
| 3,845,783 | 11/1974 | De Lepeleire | 92/34 |
| 3,861,277 | 1/1975 | Wagner | 92/45 |

FOREIGN PATENT DOCUMENTS

| | | | |
|---|---|---|---|
| 687526 | 3/1929 | France | 92/34 |

*Primary Examiner*—Abraham Hershkovitz
*Attorney, Agent, or Firm*—Harrington A. Lackey

[57] ABSTRACT

A product and method of making a bellows from thermoplastic sheet material including forming a plurality of substantially U-shaped gussets having inside and outside edges, heat-sealing the inside edges of the gussets in pairs, heat-sealing the outside edges of adjacent pairs in an accordion-like stack, and then heat-sealing the stack of sealed gussets between a folded cover member of thermoplastic sheet material having an air passage through the cover member for communication with an expansible air chamber formed by the cover member and the gussets.

9 Claims, 16 Drawing Figures

PRODUCT AND METHOD OF MAKING BELLOWS

BACKGROUND OF THE INVENTION

This invention relates to the product and method of making bellows, and more particularly to the method of making bellows from thermoplastic sheet material.

Heretofore, bellows, particularly the type which are incorporated in a breathing testing machine or spirometer have been made entirely of rubber. In a conventional process for making rubber bellows, a model of solid material made in the shape of a bellows is repeatedly dipped in a bath of molten latex in order to build up a succession of laminations of latex until the desired thickness of the rubber bellows is attained.

Because of the relatively high cost of rubber bellows, such bellows are used repeatedly in breathing machines or spirometers, thus accumulating bacteria within the bellows from different patients, to create a highly unsanitary condition.

SUMMARY OF THE INVENTION

It is therefore an object of this invention to overcome the enumerated disadvantages of rubber bellows by providing an entirely different, and less expensive, method of making bellows from thermoplastic sheet material, with a reduction in costs that would permit the thermoplastic bellows to be disposable after use by each person.

The method of this invention, first of all, utilizes a material, namely thermoplastic sheet material, such as polyvinyl chloride plastic, of substantially less cost than natural or artificial rubber. Furthermore, the step of melting the raw material to form a liquid bath is entirely eliminated.

The thermoplastic sheet material is cut into a minimal number of patterns, namely a plurality of U-shaped gusset strips and a single cover member. The gusset members are alternately heat-sealed along their inner and outer edges to form an accordionlike stack of gussets, which in turn are placed within the folded cover member and heat-sealed along the margins to completely enclose an expansible air chamber. An air passage is formed in the folded edge portion of the cover member to permit air to be introduced and exhausted from the expansible air chamber.

In the preferred form of the invention, a spacer member is secured to the inner surface of the top cover panel within the air chamber in order to maintain the top and bottom panels always separated, even when the air chamber is completely collapsed, thereby permitting the cover panels to be immediately separated upon the introduction of air, such as by the exhalation of a medical patient into the bellows chamber.

DESCRIPTION OF THE PREFERRED EMBODIMENTS

Figure 1:
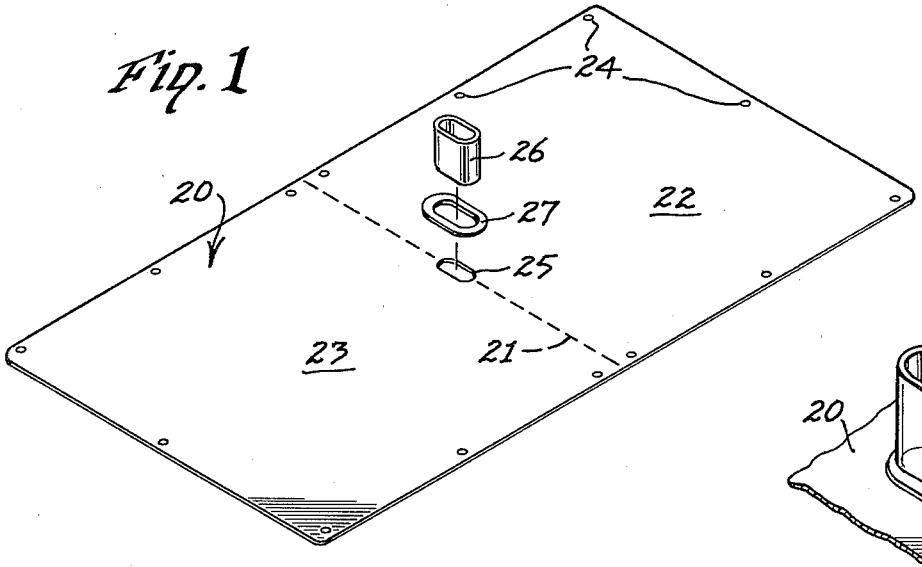
FIG. 1 is an exterior perspective view of the blank of plastic sheet material from which the cover member is made, and an exploded view of the air inlet member.
Figure 2:
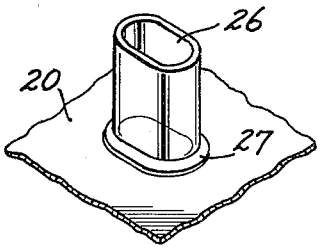
FIG. 2 is an enlarged fragmentary perspective view of the assembled air inlet member on the cover member blank.

Referring now to the drawings in more detail, FIG. 1, discloses a rectangular blank 20 of thermoplastic sheet material, such as polyvinyl chloride, adapted to be folded about its transverse mid-line 21, to form an upper or top cover panel 22 and a lower or bottom cover panel 23. The periphery of the blank 20 is preferably provided with registration pin holes 24 to align the blank 20 with other sheet material elements for heat-sealing. The blank 20 may be die cut from a larger sheet of polyvinyl chloride (PVC) material or other thermoplastic material. An oblong air hole 25 is cut in the center of the blank 20, preferably along the fold line 21. A plastic air inlet tube 26 is secured to the air hole 25 by flow-molding, in a preferred form of the invention. The tube 26 may also be secured by heat-sealing the tube 26 and grommets 27 and 28 to both sides of the air hole 25, as best disclosed in FIGS. 2 and 9.

Figure 3:
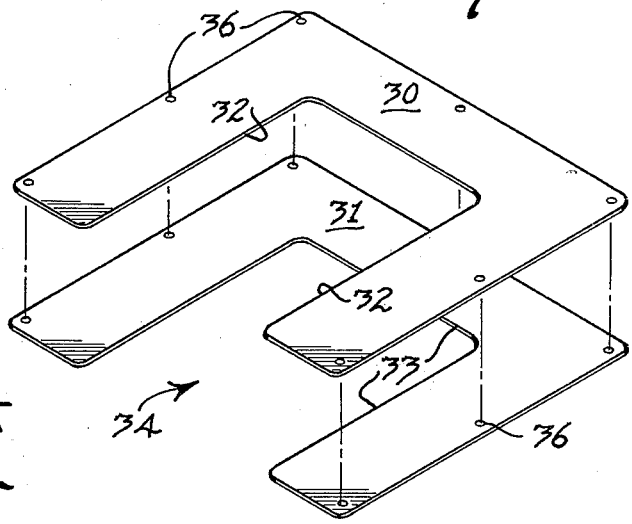
FIG. 3 is an exploded view of a pair of gusset blanks.
Figure 7:
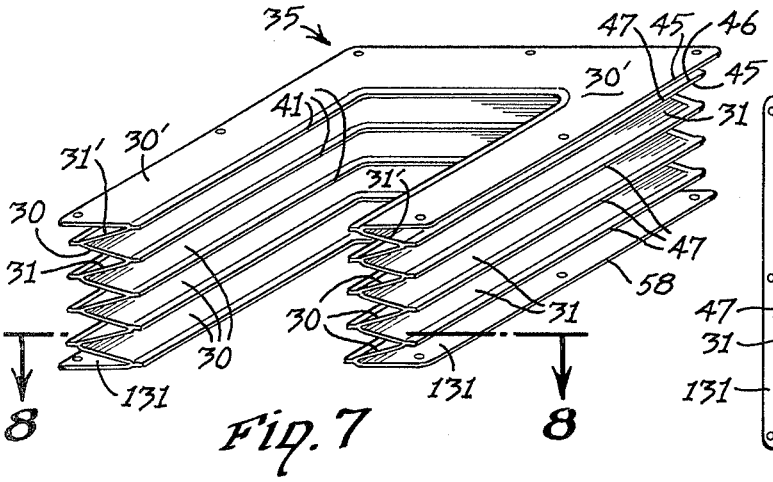
FIG. 7 is a top, open-end perspective view of a completed gusset assembly.
Figure 8:
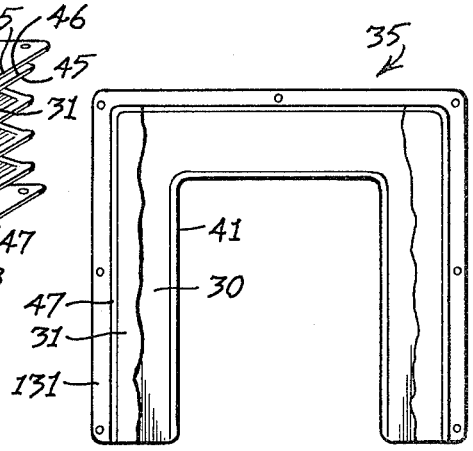
FIG. 8 is a section taken along the line 8—8 of FIG. 7.
Figure 10:
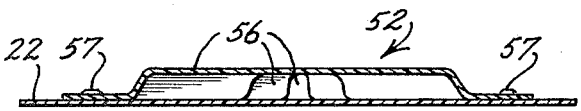
FIG. 10 is an enlarged section taken along the line 10—10 of FIG. 9.

Also formed, such as by die cutting, preferably out of the same thermoplastic sheet material as the blank 20, are a plurality of, in this case ten, flexible plastic gussets, such as gussets 30 and 31 disclosed in FIG. 3. These gussets 30 and 31 are preferably U-shaped, although they may be of other shapes so that their respective side edges 32 and 33 substantially define an opening 34 through the planes of the respective gusset blanks 30 and 31. Each of the gussets 30 and 31, as well as all of the remaining gussets in the gusset assembly 35 (FIG. 7), are of identical size and shape. The outside perimeters of the gusset blanks 30 and 31 may also be provided with the register pin holes 36 having the same function as the pin holes 24 in the cover blank 20.

Figure 4:
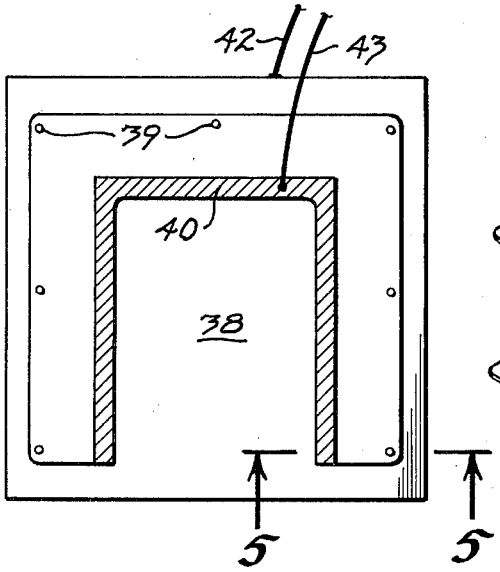
FIG. 4 is a top plan view of a pair of gusset blanks mounted on dies for heat-sealing the interior edges.
Figure 5:
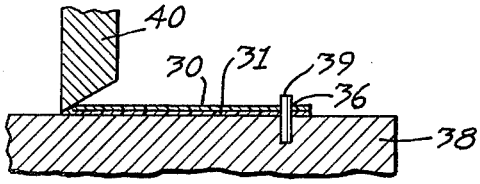
FIG. 5 is an enlarged fragmentary section taken along the line 5—5 of FIG. 4.
Figure 6:
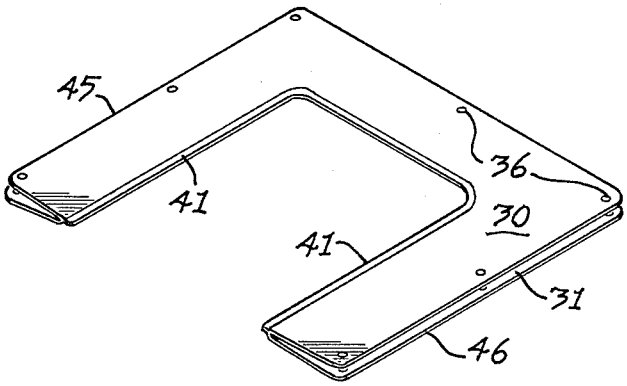
FIG. 6 is a top perspective view of a pair of gussets whose inner edges have been heat-sealed.

As the initial step in fabricating the gusset assembly 35 (FIG. 7), a first pair of gussets 30 and 31 are superimposed upon each other, as illustrated in FIG. 3, and placed as a superimposed pair upon the platen 38 (FIG. 4) and held in their superimposed aligned position by corresponding register pins 39. An inner U-shaped die 40 is then lowered to heat-seal the inside edges 32 and 33 together to form a fused inside edge 41 (FIGS. 5 and 6).

The heat-sealing is preferably effected by a high-frequency radiant energy such as employed in dielectric heating. The plate 38 is connected through lead 42, and die 40 is connected through lead 43, to the radiant energy heating source, not shown, but of a conventional type.

After the first pair of gussets 30 and 31 are heat-sealed to form the inside fused edge 41, as disclosed in FIG. 6, then the other gussets 30 and 31 are subsequently arranged in superimposed pairs, placed on the platen 38, and heat-sealed in the same manner, until five pairs of gussets have been formed, each including an upper gusset 30 and a lower gusset 31.

Then in consecutive order, each adjacent pair of gussets is heat-sealed together along their adjacent outside edges to form the gusset assembly 35. In this process a first pair of gussets, such as the upper pair 30′ and 31′ (FIG. 7), are heat-sealed to the next lower pair 30 and 31 by heat-sealing only continuous outside edge 46 of the gusset 31′ to the outside edge 45 of the gusset 30. A larger U-shaped die, not shown, similar to the U-shaped die 40, is utilized to heat-seal the outside edges 46 and 45. Thus, the heat-sealed edges 46 and 45 become the integral fused outside edge 47, as disclosed in FIG. 7.

Figure 14:
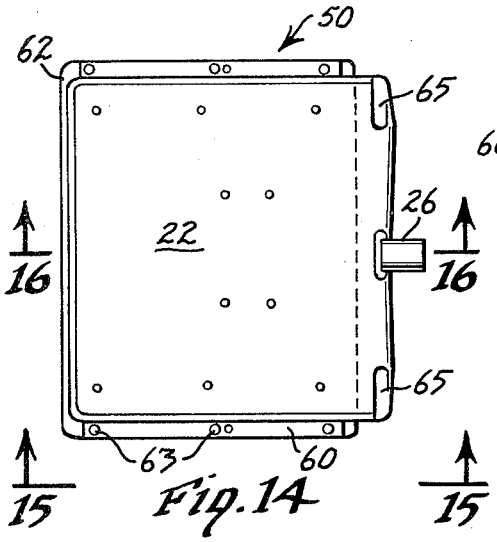
FIG. 14 is a top plan view of the completed bellows.
Figure 15:
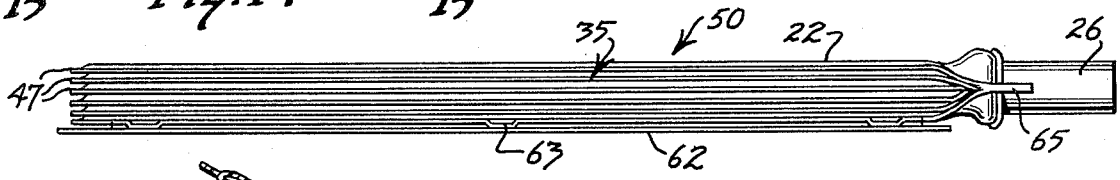
FIG. 15 is an enlarged side elevation taken along the line 15—15 of FIG. 14, with the bellows collapsed.
Figure 16:
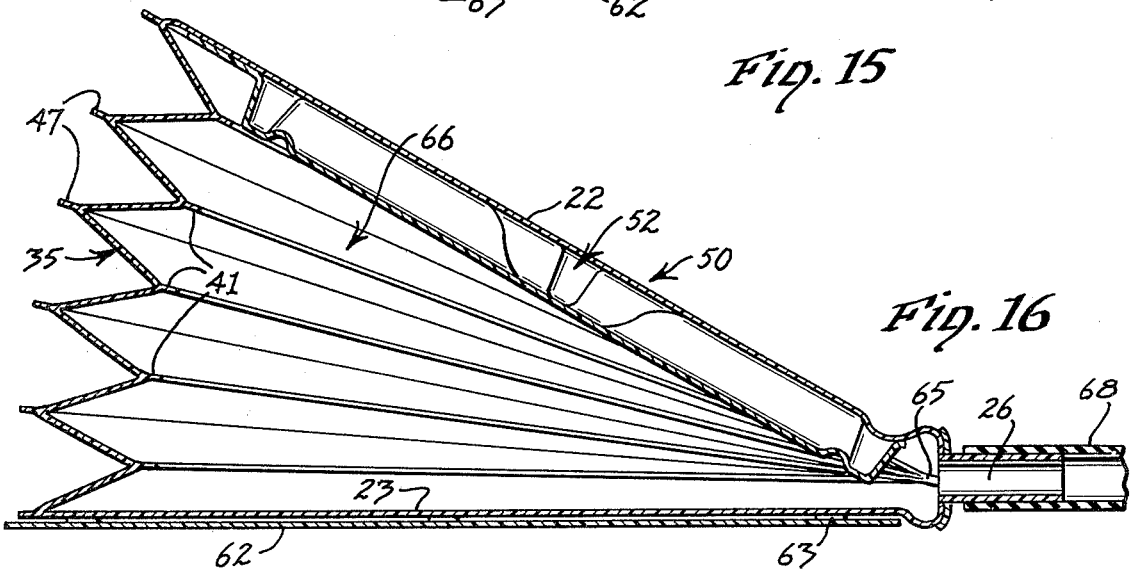
FIG. 16 is an enlarged section taken along the line 16—16 of FIG. 14, with the bellows expanded.

The process is repeated for heat-sealing the adjacent outside edges 45 and 46 of each successive pair of gussets 30 and 31 until the outside edge of the upper gusset 30 of pair 30 and 131, is heat-sealed to the outside edge of the next superadjacent gusset 31. Thus, with all of the outside edges 45 and 46 of adjacent pairs of gussets 30 and 31 secured together to form the fused outside edges 47, the gusset assembly 35 is completed to form a large accordion-like, U-shaped wall surrounding the vertical openings 34, which will ultimately constitute an expansible air chamber within the finished bellows 50 (FIGS. 14, 15, and 16).

After the air inlet tube 26 has been heat fused to the air hole 25 in the cover blank 20, a spacer member 52 is fused to the interior surface of the top cover panel 22. The spacer member 52 may be a stamped or molded, substantially rectangular, rigid piece of plastic, having a base 53 and a plurality of upstanding ridges, such as the transverse ridges 54 and 55 and the radially extending ridges 56, as best disclosed in FIG. 9. These ridges 54, 55, and 56 are preferably of equal height and high enough to maintain the separation of the bottom cover panel 23 and the top cover panel 22 when folded upon each other and when the bellows 50 is in a collapsed position, such as disclosed in FIG. 15. Thus, the spacer member 52 will maintain an initial volume of air within the bellows 50, even when the bellows 50 is in its collapsed position (FIG. 15), so that a person exhaling air into the bellows 50 through the air inlet tube 26 will not waste his breath in merely expanding the bellows to an initial starting point for measurement.

Figure 9:
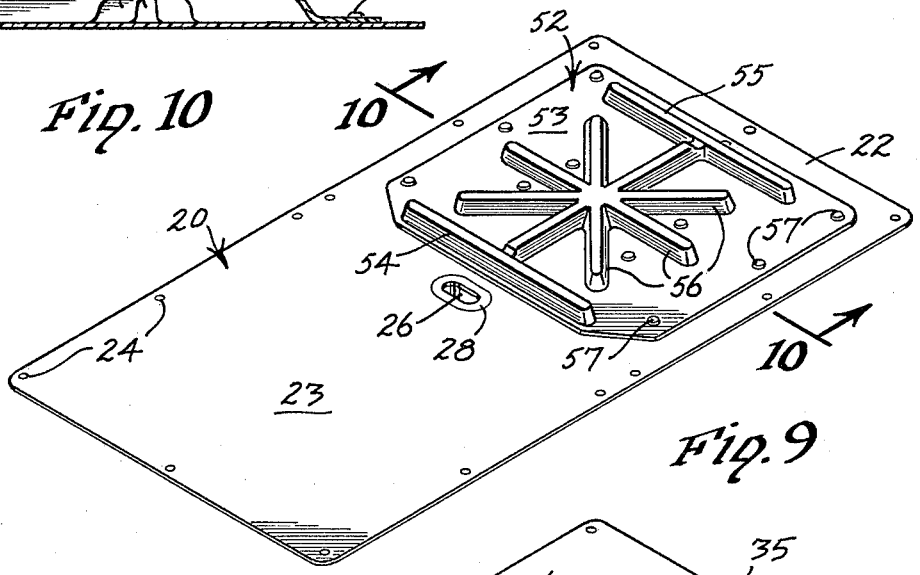
FIG. 9 is a perspective view of the interior of the cover member blank upon which the air inlet member and the spacer member have been assembled.

The spacer member 52 is secured flush against the interior surface of the top cover panel 22 by means such as spot heat-welding or sealing at the fused points 57 (FIG. 9).

The spacer member 52 is spaced centrally of the top cover panel 22 and is of sufficient transverse dimensions that it will maintain the major portions of the top cover panel 22 and the bottom cover panel 23 separated from each other, without interfering with the collapsed gusset walls 30 and 31.

Figure 11:
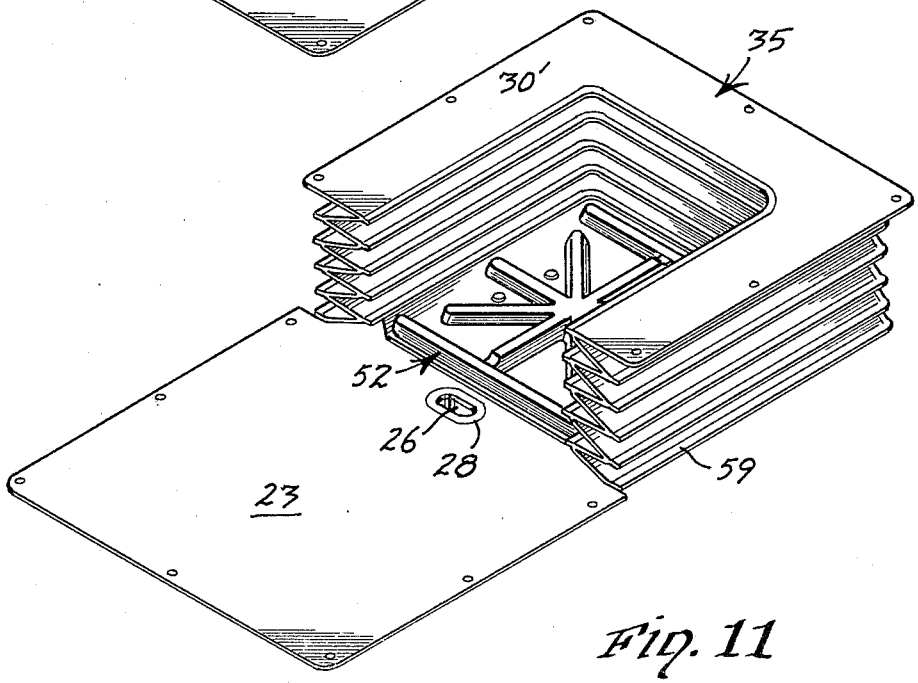
FIG. 11 is a view similar to FIG. 9 in which the gusset assembly has been sealed to the top cover panel member.

After the spacer member 52 is spot-fused to the top panel 22, then the gusset assembly 35 is positioned around the spacer member 52, as discloed in FIG. 11, and the outside edge 58 (FIG. 7) of the lowermost gusset 131 is heat-sealed around its entire periphery to the margin of the top cover panel 22 to form the fused outside edge 59 (FIG. 11).

Figure 12:
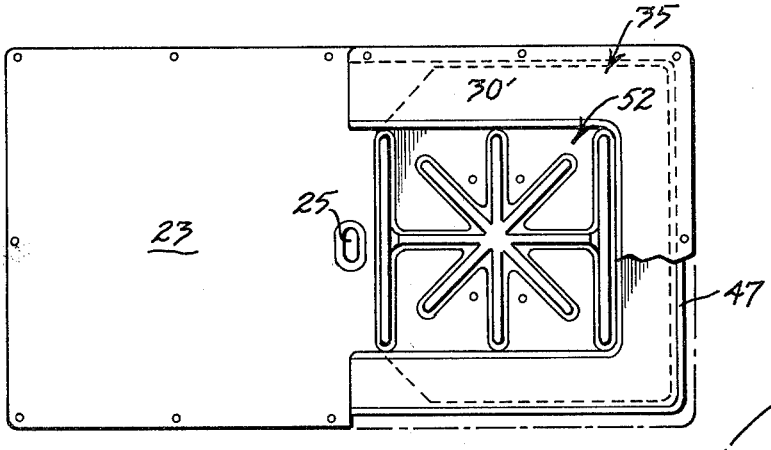
FIG. 12 is a top plan view of the assembly disclosed in FIG. 11 with a portion of the top end gusset broken away.

As illustrated in the drawings, as the various blanks are engaged by the respective dies, such as die 40, not only are the adjacent edges of the plastic parts heat-sealed together, but the projecting margins of the free edges of the sheet material are cut and discarded, as illustrated in FIGS. 11 and 12.

Figure 13:
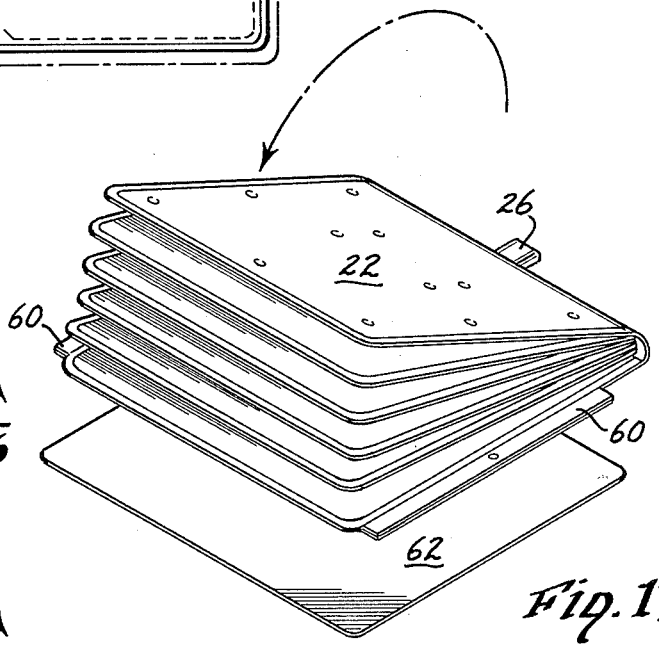
FIG. 13 is a top perspective view of the gusset assembly sealed between the cover panels, preparatory to being secured to the base member.

The top cover panel 22, now secured to the spacer member 52 and the gusset assembly 55, is then folded and turned upside down (FIG. 13) about its transverse fold line 21 (FIG. 1) until the upper gusset 30′ (now on the bottom of the gusset assembly 35) engages flush against the interior marginal surface of the bottom cover panel 23. The outer edge 45 of the gusset panel 30′ is then heat-sealed against the corresponding surface of the bottom cover panel 23. However, the marginal strips of the bottom cover panel 23 are permitted to remain along the periphery of the heat-sealed edges. These marginal securing strips 60 are then spotfused or welded to a rectangular rigid base 62 of heavier rigid plastic material, by the spot seals 63.

As illustrated in FIGS. 14 and 15, the folded rear corner portions 65 of the cover member 20 are heat-fused to seal the free edges of all of the gussets 30, 31, 30′, 31′ and 131 so as to completely enclose the expansible air chamber 66 (FIG. 16) within the bellows 50, except for the air inlet tube 26.

The air inlet tube 26 may be connected to a longer flexible tube or conduit 68 (FIG. 16) to facilitate blowing into the bellows 50 by the patient or other user of the bellows 50.

The function of the base member 62 is to provide a relatively stable support for the bellows 50, and also is adapted to be positioned within a corresponding recess within a conventional breathing testing machine or spirometer, not shown.

In use, of couse, when the bellows 50 is positioned within the spirometer, the bellows will normally rest in its collapsed position as disclosed in FIG. 15 with the top cover panel 22 resting in spaced relationship above the bottom cover panel 23 by virtue of the spacer member 52. Thus, when the patient places the conduit 68 into his mouth and exhales, the top cover panel 22 will immediately begin to rise to cause the gusset assembly 35 to expand commensurate with the volume of the air exhaled from the patient into the air chamber 66. This expansion is appropriately sensed and measured and recorded by the spirometer in a well-known manner, none of which parts are disclosed in the drawings.

The arrangement or pattern of the ridges 54, 55 and 56 in the spacer member 52 are not particularly critical except that they should span the major portions of the space at the particular height of the ridges in order to maintain the entire top cover panel 22 elevated at a substantially uniform height above the bottom cover panel 23.

What is claimed is:

1. A bellows comprising:

(a) a top panel of plastic sheet material having front, side and rear edges, (b) a bottom panel of plastic sheet material having front, side and rear edges, the rear edge of said bottom panel integrally joining the rear edge of said top panel to form a hinged connection, (c) a generally U-shaped, accordion-like wall comprising a plurality of vertically stacked, substantially U-shaped gussets, including a top gusset and a bottom gusset, (d) each of said gussets being formed of a strip of flexible plastic sheet material and comprising a continuous front portion and opposed side portions coplanar with said strip of sheet material, each gusset having an inside edge and an outside edge, (e) means integrally and continuously joining alternate adjacent pairs of said inside edges and said outside edges to form said accordion-like wall having expansible front and side wall portions, (f) means integrally and continuously joining the outside edges of the top and bottom gussets to said top and bottom panels, respectively, to form an air chamber between said top and bottom panels and said accordion-like wall, (g) an air inlet extending through one of said top or bottom panels to communicate with said air chamber, and (h) a spacer member within said air chamber of generally uniform height for engaging and separating said top and bottom panels when said bellows is in its collapsed position.

2. The invention according to claim 1 in which said opposed side portions terminate in rear edges, and means joining said rear edges and said top and bottom panels.

3. The invention according to claim 1 in which said spacer member comprises a plurality of spaced ridge members of uniform height engaging said top and bottom panels in said collapsed position.

4. A method of making a bellows comprising the steps of:

(a) forming a plurality of gussets of strips of flexible sheet material of uniform size, each gusset having an inside edge generally defining an opening through said strip of sheet material, an outside edge, and a rear portion, (b) arranging said gussets in superimposed pairs, (c) sealing together the inside edges of each pair of said gussets, (d) arranging at least a first pair and a second pair of gussets in superimposed relation, (e) sealing together only the outside adjacent edges of said first and second pair of superimposed gussets to form a stack of accordion-like gussets having first and second opposite end gussets with free outside edges, (f) forming a cover member of sheet material, having interior and exterior surfaces, (g) forming an air passage through said cover member, (h) folding said cover member over said rear portion to form a first cover panel adjacent said first end gusset and a second cover panel adjacent said second end gusset, and (i) sealing the interior surface of said first cover panel to said first end gusset and the interior surface of said second cover panel to said second end gusset to form an expansible closed air chamber communicating with said air passage and a hinged rear portion between said first and second cover panels.

5. The method according to claim 4 in which each of said gussets is generally U-shaped, the rear end portion of said gussets comprising free end edges, and sealing said free end edges of said gussets and the folded rear portion of said cover member together.

6. The method according to claim 5 further comprising the step of securing a spacer member to the interior surface of the first cover panel, the dimensions of the spacer member being less than each opening defined by the inside edges of said gussets, so that said spacer member fits within said openings when said air chamber is collapsed.

7. The method according to claim 5 in which said sheet material is thermoplastic sheet material and said sealing steps comprise heat-sealing the corresponding portions of the thermoplastic sheet material.

8. The method according to claim 5 in which the step of forming an air passage comprises forming an air passage through the folded rear portion of said cover member.

9. The method according to claim 5 further comprising the step of securing to the exterior surface of said second cover panel a base member of at least the same transverse dimensions as said second cover panel, said base member being more rigid than said sheet material.

* * * * *